US011945613B2

(12) United States Patent
Sauerwein et al.

(10) Patent No.: US 11,945,613 B2
(45) Date of Patent: Apr. 2, 2024

(54) COMPRESSED BALE, PACKAGING DEVICE AND PRODUCTION DEVICE FOR COMPRESSED BALES

(71) Applicant: AUTEFA SOLUTIONS GERMANY GMBH, Friedberg (DE)

(72) Inventors: Norbert Sauerwein, Augsburg (DE); Dirk Falise, Kaufering (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 0 days.

(21) Appl. No.: 17/761,401

(22) PCT Filed: Sep. 23, 2020

(86) PCT No.: PCT/EP2020/076561
§ 371 (c)(1),
(2) Date: Mar. 17, 2022

(87) PCT Pub. No.: WO2021/058559
PCT Pub. Date: Apr. 1, 2021

(65) Prior Publication Data

US 2022/0371759 A1 Nov. 24, 2022

(30) Foreign Application Priority Data

Sep. 25, 2019 (DE) ..... 20 2019 105 299.6
Aug. 6, 2020 (DE) ..... 20 2020 104 547.4

(51) Int. Cl.
*B65B 27/12* (2006.01)
*B65B 11/10* (2006.01)
(Continued)

(52) U.S. Cl.
CPC ..... *B65B 27/125* (2013.01); *B65B 11/10* (2013.01); *B65B 13/06* (2013.01); *B65D 85/07* (2018.01)

(58) Field of Classification Search
CPC ..... B65B 11/10; B65B 13/06; B65B 27/125; B65D 85/07
(Continued)

(56) References Cited

U.S. PATENT DOCUMENTS 893,007 A 7/1908 Mueller
3,584,428 A 6/1971 Falk
(Continued)

FOREIGN PATENT DOCUMENTS

CN 107284725 A 10/2017
DE 3422140 A1 12/1985
(Continued)

*Primary Examiner* — Bryon P Gehman
(74) *Attorney, Agent, or Firm* — McGlew and Tuttle, P.C.

(57) ABSTRACT

A packaging of compressed bales (1) includes packaging (11) surrounding the compressed bale. The compressed bale is formed from highly compressed, preferably short-cut, textile fibers and has mutually opposite pressing sides (5, 6), which are acted upon by a pressing device (32) in a pressing direction (10), and circumferential sides (7, 8), which are arranged between the pressing sides. The packaging has multipart film packaging (12) resting on the bale body (4) and first strapping (22) with a plurality of parallel endless bands (23) that are laid over the pressing sides of the compressed bale. An additional strapping (25) having a plurality of endless strapping bands (26, 27) are applied to the compressed bale. The strapping bands are laid peripherally only over the circumferential sides and are arranged externally on the film packaging and on the bands. The strapping bands cross the bands, forming cross strapping (21).

20 Claims, 9 Drawing Sheets

(51) Int. Cl.
*B65B 13/06* (2006.01)
*B65D 85/07* (2017.01)

(58) Field of Classification Search
USPC ..... 206/83.5
See application file for complete search history.

(56) References Cited

U.S. PATENT DOCUMENTS

| | | | | |
|---|---|---|---|---|
| 4,746,011 | A | 5/1988 | McNair, Jr. et al. | |
| 5,131,210 | A | 7/1992 | Kiya | |
| 10,716,326 | B2 * | 7/2020 | Miida | B65B 27/125 |
| 2005/0284775 | A1 * | 12/2005 | McLaughlin | B65B 27/125<br>53/436 |
| 2020/0239169 | A1 * | 7/2020 | Davila | B65B 27/125 |

FOREIGN PATENT DOCUMENTS

| | | | |
|---|---|---|---|
| DE | 69009648 | T2 | 11/1994 |
| DE | 29517428 | U1 | 1/1996 |
| DE | 202017104766 | U1 | 11/2018 |
| EP | 0528892 | B1 | 3/1994 |
| GB | 1077101 | A | 7/1967 |
| GB | 2134478 | A | 8/1984 |
| WO | 2005012098 | A1 | 2/2005 |
| WO | 2015114532 | A1 | 8/2015 |

* cited by examiner

Fig. 1
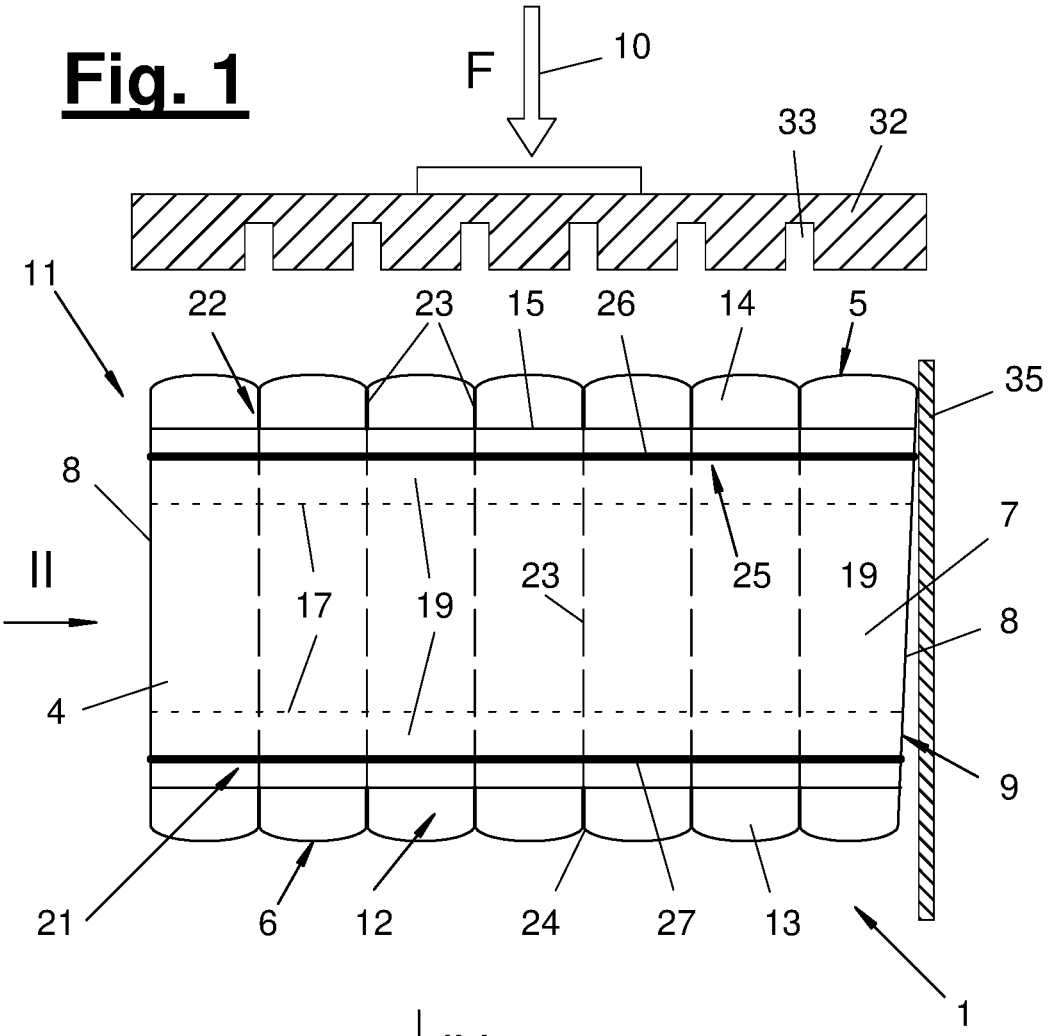
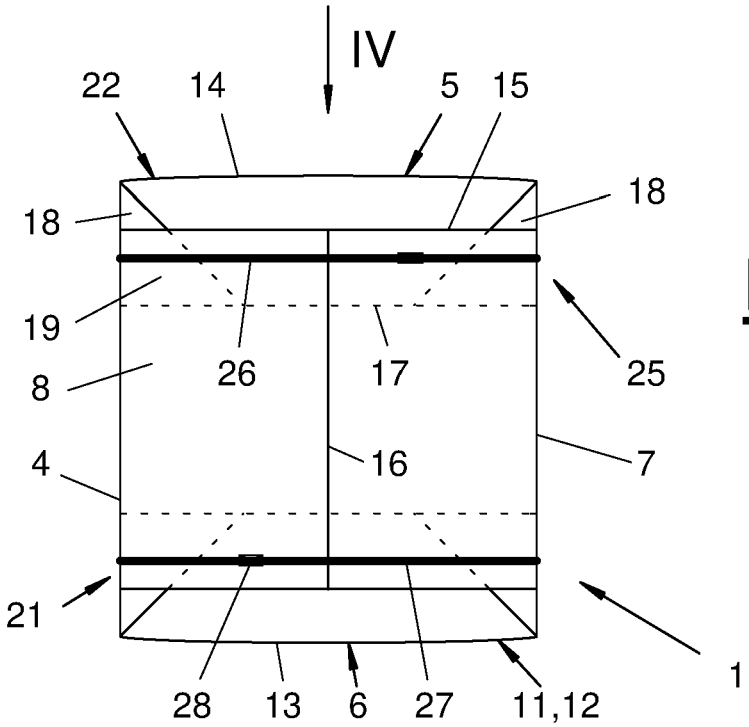
Fig. 2

COMPRESSED BALE, PACKAGING DEVICE AND PRODUCTION DEVICE FOR COMPRESSED BALES

CROSS REFERENCE TO RELATED APPLICATIONS

This application is a United States National Phase Application of International Application PCT/EP 2020/076561, filed Sep. 23, 2020, and claims the benefit of priority under 35 U.S.C. § 119 of German Applications DE 20 2019 105 299.6, filed Sep. 25, 2019, and DE 20 2020 104 547.4, filed Aug. 6, 2020, the entire contents of which are incorporated herein by reference.

TECHNICAL FIELD

The present invention pertains to a compressed bale, to a packaging device together with a packaging process and to a production device for compressed bales wherein the compressed bale is formed from highly compressed, short-cut, textile fibers and has mutually opposite pressing sides and circumferential sides arranged between the pressing sides and the pressing sides were acted on by a pressing device in a pressing direction during the manufacture of the compressed bale and the packaging has a multipart film packaging resting on the bale body and a strapping with a plurality of parallel endless bands that are laid over the pressing sides of the compressed bale.

TECHNICAL BACKGROUND

Providing a compressed bale made of highly compressed and preferably short-cut textile fibers with a multipart film packaging and with a strapping consisting of a plurality of parallel endless bands is known from practice. The bands of the strapping are laid over the pressing sides of the compressed bale or of the bale body thereof. The pressing sides are located opposite one another on different sides of the body, wherein a plurality of circumferential sides are arranged between the pressing sides in case of the usual cuboid compressed bale. The pressing sides are acted on by a pressing device in a pressing direction during the manufacture of the compressed bale. The strapping is applied to the compressed bale, which is subsequently relieved and thereby expands mainly in the pressing direction against the retaining force of the strapping and of the bands thereof. The bands can dig especially deeply into the expanded bale body on the pressing sides and form constrictions.

SUMMARY

An object of the present invention is to demonstrate an improved compressed bale and an improved packaging technology.

The present invention accomplishes this object with the packaged compressed bale and the packaging technology, i.e., the packaging device, packaging process and a production device for compressed bales, that have various advantages.

The compressed bale is provided with a cross strapping by the packaging technology of the invention. This cross strapping is comprised of the one first strapping with the plurality of parallel endless bands and of an additional strapping, which has a plurality of, in particular two, endless and preferably tightened strapping bands. The strapping bands cross the bands of the one first strapping. The strapping bands are arranged externally on the bands and may possibly touch same.

The bands of the one first strapping are guided over said pressing sides of the compressed bale and of its bale body. They also extend over two of the circumferential sides. These are preferably the broad sides of an essentially cuboid bale body. The strapping bands of the additional strapping are laid only over the plurality of, in particular four, circumferential sides of the compressed bale and of its bale body. They are not guided over the pressing sides.

The compressed bale may usually have a rectangular cuboid shape. It may also have a cuboid-like shape with a plurality of circumferential sides in a trapezoidal shape. The parallel sides of the trapezoidal shape may be formed by the pressing sides, wherein the oblique sides of the trapezoidal shape are arranged on the circumferential sides. The trapezoidal shape extends towards the pressing direction, and the circumference on the pressing side that is acted on by a driven pressing device is the largest. The trapezoidal shape may be formed due to frictional resistance at a box wall during the filling in and pressing of the fiber material in a press box.

Said pressing sides of the compressed bale are oriented at right angles to the pressing direction. As a rule, they are also arranged parallel to one another. The plurality of circumferential sides are oriented along said pressing direction or obliquely to said pressing direction in case of a trapezoidal shape. Four circumferential sides are present in case of a cuboid shape or a cuboid-like shape with corners and edges.

The strapping bands of the additional strapping are arranged parallel to one another and parallel to the pressing sides. The additional strapping preferably has two strapping bands, which are arranged off-center and close to said pressing sides. The number of the strapping bands may also be larger.

The one strapping and the additional strapping may be applied to the compressed bale with a time offset and at different processing locations. It is advantageous to first apply the preferably multipart film packaging at least partially to the compressed bale and then to apply the one strapping. The latter may take place at the still pressed and compressed bale, which subsequently expands after press relief, especially in the pressing direction, and is clamped into the relatively loosely placed one first strapping. Subsequently, the additional strapping is applied over the one first strapping, preferably on the already expanded compressed bale.

The multipart film packaging may rest directly on the bale body of the compressed bale. It may fully envelop the bale body on all sides. This is advantageous for the protection of the compressed bale against external environmental effects. The one first strapping may rest externally on the film packaging. It may fix the film packaging to the compressed bale.

The compressed bale and the packaging technology of the invention have the advantage that the compressed bale is stabilized in its shape by the cross strapping. It may, as a result, be stacked better and higher for storage purposes, which reduces storage and cost expenses.

Further, the multipart film packaging may be fixed by the cross strapping better to the compressed bale and to its bale body. The better fixing may lead to better tightness of the film packaging. This is advantageous for sensitive fiber material, which is used in the hygiene sector, e.g., in the case of diapers or the like.

The film packaging may be formed from a plurality of flexurally elastic packaging films, which preferably consist of plastic, e.g., PE, PP, or the like. One or more packaging films may be stretchy. One or more packaging films may have a tension-proof and stretch-resistant configuration, e.g., as ribbon film or fabric film.

The flexurally elastic packaging film is sufficient for secure and tight enveloping of the compressed bale. It is economic and also has advantages for the later unpacking of the compressed bale and for the disposal of the packaging material. Additional and possibly reinforcing packaging means, such as cardboard lids, cover plates or the like are not necessary and may be dispensed with.

The film packaging may have, e.g., a two-part configuration with a bottom film and a top film, or a three-part configuration with a bottom film and a top film as well as with an endless cover film. A three-part film packaging has advantages for the tight enveloping of the bale body on all sides and for the film consumption as well as for the unpacking effort.

The bottom film and/or the top film may be formed from flat film blanks. They may be applied to the bale body on a pressing side and may possibly be folded over. The folded-over bottom film and/or top film may cover a pressing side and cover the edge areas of the adjoining circumferential sides with an edge fold. During the folding over, a corner fold may be formed and may be folded over onto a circumferential side, e.g., onto a broad side.

As an alternative, a configuration of the bottom film and/or of the top film as a hood which is open on one side or as a bag is possible. The hood or the bag rests with the peripheral side wall on the circumferential sides of the bale body and covers these at least over a part of the body height.

The cover film encloses all circumferential sides of the bale body in a closed ring shape. The cover film may be configured as endless or finite with an overlapping of its film ends. The width of the cover film is preferably smaller than the height of the bale body. The longitudinal edges of the cover film, which is preferably applied in a centrally symmetrical manner to the bale body, then have a distance from the pressing sides of the bale body. The longitudinal edges of the cover film may overlap with an edge fold of the bottom film and/or of the top film or with a peripheral side wall of a hood or of a bag.

The additional strapping is especially advantageous for fixing folded-over edge folds and possibly folded-over corner folds of the bottom film and top film, which are each laid on a circumferential side of the bale body and fixed here. Further, an overlap by the additional strapping may be fixed and sealed, which additional strapping is formed between a cover film on the circumferential side or the circumferential sides and other parts of the film packaging.

Such other parts of the film packaging may be said bottom film and top film and the edge folds as well as possibly corner folds thereof. On the other hand, other parts of the film packaging may be used, which have, e.g., a spatial and already predefined shape, e.g., a hood shape or a bag shape.

An endless cover film may be formed from an finite piece of film, the ends of which are connected to one another with a connection means, especially with a weld seam. If the cover film consists of a material that does not have elongation elasticity or has only minimal elongation elasticity, the cover film may have a greater circumference and an overhang vis-à-vis the compressed bale or its bale body. At least one strapping band of the additional strapping may be arranged on the overhang and may fix and seal same.

The multipart film packaging may be applied completely or partially before applying the strapping to the bale body. In a first variant, all parts of the film packaging, e.g., a bottom film and a top film in folded-over form or in a hood form as well as a cover film, may be applied together before the strapping and subsequently be strapped together with the one first strapping.

In another, second variant, individual parts of the film packaging, e.g., said bottom film and said top film may be applied first, e.g., in a baling press and to the compressed bale held under compression. These packaging parts may subsequently be strapped with the one first strapping, which may take place likewise in a baling press and to the compressed bale held under compression. Another part of the film packaging, especially a cover film, may be applied later. Such an other part may be laid externally over said parts of the film packaging as well as over the strapping.

The application of the other part or of the cover film may take place outside of a baling press and possibly at the compressed bale, which is relieved from the compression and is already provided with parts of the film packaging as well as strapped. This saves time, especially cycle time of the baling press and may also take place at a central location of a baling press plant. The additional strapping with the two or more strapping bands may then be laid over the other part or the cover film. The other part of the cover film is located between the one first strapping and the additional strapping.

Another advantage of the strapping bands of the additional strapping, which strapping bands are preferably arranged close to the pressing sides, is the above-mentioned cuboid-like shape with the trapezoidal-shaped circumferential sides. Here, the circumferential length at the upper and lower areas of the trapezoidal shape is of a different magnitude. The strapping bands of the additional strapping, which strapping bands are arranged and tightened here, may stabilize the trapezoidal shape in a special manner. They may especially counteract an undesirable deformation of the packaged compressed bale due to axial forces, e.g., due to gravitational forces in a stack of bales. The strapping bands may be tightened and possibly retightened once or multiple times, as this is possible, e.g., for plastic bands and with known strapping units. Consequently, the band tension may be evened out and also adjusted as needed. A friction-welded closure of the strapping bands may be advantageous in this case.

The compressed bale of the invention and the packaging technology of the invention have special advantages when the textile fibers of the compressed bale are configured as thermosensitive synthetic fibers made of a polymer, e.g., viscose, polyester, polypropylene, polyethylene, polyamide, acetate, acryl or mixtures of these materials. This pertains especially to multicomponent fibers, e.g., so-called BiCo fibers. The thermosensitive fibers may have a low melting point, which is, e.g., between 60° C. and 200° C. The textile fibers are intended and configured for the industrial further processing, e.g., as a nonwoven product, as cross-linked products, e.g., a woven or knitted product.

When the film packaging is formed from a material that is meltable under heat, especially a plastic, e.g., polyethylene or polypropylene, the packaging technology of the invention has special advantages. It acts purely mechanically and does not exert any thermal effect on a meltable film packaging and on thermosensitive synthetic fibers. Melting phenomena and contaminations of the synthetic fibers can consequently be avoided. This is especially advantageous in case of fiber materials for a later use in the hygiene area.

The multipart film packaging may be formed from packaging films which are made of identical or different materials, especially plastics. For example, different mechanical stresses can be taken into account due to the use of different materials. A bottom film and/or a top film consisting of a mechanically resilient and possibly tension-proof and stretch-resistant material, e.g., PP, ribbon film or fabric film or the like may be used for covering the pressing sides, the corners and an edge area of the circumferential sides. The cover film may be formed from a less resilient and possibly stretchy material, e.g., PE. The stretchy property may be favorable for minimizing the overhang at the bale body.

The compressed bale of the invention and its packaging may have a different configuration. The bottom film and the top film of the multipart film packaging may be arranged on the pressing sides and cover the adjoining circumferential sides in some areas. The bottom film and the top film may each have said folded-over shape or the hood shape or bag shape. The multipart film packaging may, in addition, have a cover film on the circumferential sides, which externally overlaps and covers the bottom film and the top film on the circumferential sides in at least some areas, wherein at least one strapping band of the additional strapping is arranged on the overlap.

In one variant, the one first strapping may be arranged externally directly and with contact on the bottom film, on the top film and on the cover film, wherein the additional strapping is arranged externally on the bottom film, on the top film and on the cover film as well as on the one strapping preferably directly and with physical contact.

In another variant, the one first strapping may be arranged externally directly on the bottom film and on the top film, wherein the cover film is preferably arranged directly and with physical contact externally on the bottom film, on the top film and on the one strapping, and wherein the additional strapping is arranged preferably directly and with physical contact externally on the cover film.

The packaging technology of the invention has especially the advantage that it mechanically fixes and seals the film packaging on the compressed bale as well as stabilizes the compressed bale and thereby efficiently ensures the quality of the fiber material.

The packaging device and the packaging process of the invention may have at least one strapping apparatus and a strapping process, which are configured for applying said additional strapping on the circumferential sides of the compressed bale or of the bale body. Such a packaging device and packaging process can be used independently. They may be used for retrofitting purposes. The additional strapping may thus be applied later to a compressed bale already provided elsewhere with a film packaging and with a strapping. The packaging device and packaging process of the invention may be added to an available conventional packaging technology by way of a retrofit.

Except for the strapping apparatus together with the strapping process, the packaging device and the packaging process of the invention may have additional components. These may be, e.g., a strapping device for the one first strapping and/or an application device for the multipart film packaging as well as the associated process. Such a completed packaging device and the packaging process may be used in a production device together with production process by way of the original equipment or retrofitting.

The production device of the invention as well as the production process may comprise a packaging device and a packaging process of the above-mentioned type. The production device may in this case have one or more compressed bales. As an alternative, compressed bales can be produced outside of the production device and be delivered to this production device.

The strapping apparatus can operate manually or preferably automatically. It may be arranged in a production device outside of the one or more compressed bales. It may be arranged especially in an external strapping station. A plurality of compressed bales may have a common strapping station.

Other components of the packaging device, especially a strapping device for the one first strapping and/or an application device for applying the film packaging may be arranged at the compressed bale or at the compressed bales. The external strapping station may already be fed compressed bales provided with a film packaging and with the first strapping as a result. This separation of the packaging technology has advantages for an optimization of the compressed bale technology and of the best possible utilization of the press cycle. In addition, a strapping apparatus may be arranged in an external strapping station with improved structural possibilities and with improved and simpler kinematics than at a baling press. The efficiency of a packaging device and of a production device may be increased significantly. In particular, the compressed bale output per hour may be high.

In the above-mentioned second variant, a strapping device and a first application component of the application device may be arranged at the baling press. The first application component applies the film packaging or the first parts of a multipart film packaging, e.g., a bottom film and a top film or at least a hood, to the compressed bale. The compressed bale and the film packaging or the first parts of a multipart film packaging may subsequently be strapped with the first strapping and be fixed.

A second application component may be arranged outside of the baling press and possibly centrally with operation of a plurality of baling presses. It applies at least one additional part of the multipart film packaging, e.g., a cover film, to the relieved and possibly already strapped compressed bale. The second application component may be assigned to said external strapping station.

A splitting of the baling press into a prepress and a finishing press and the connection thereof via a bale transporter is also favorable. A plurality of prepresses may operate on a common finishing press and the components of a packaging device located there. The arrangement of a preferably automatic strapping apparatus in one or more external strapping stations is also especially advantageous for this embodiment.

The present invention is shown in examples and schematically in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a side view of a compressed bale with a cross strapping and also showing a view of a pressing device and of a press box wall;

FIG. 2 is a front view of the compressed bale according to arrow II of FIG. 1;

DESCRIPTION OF PREFERRED EMBODIMENTS

Figure 3:
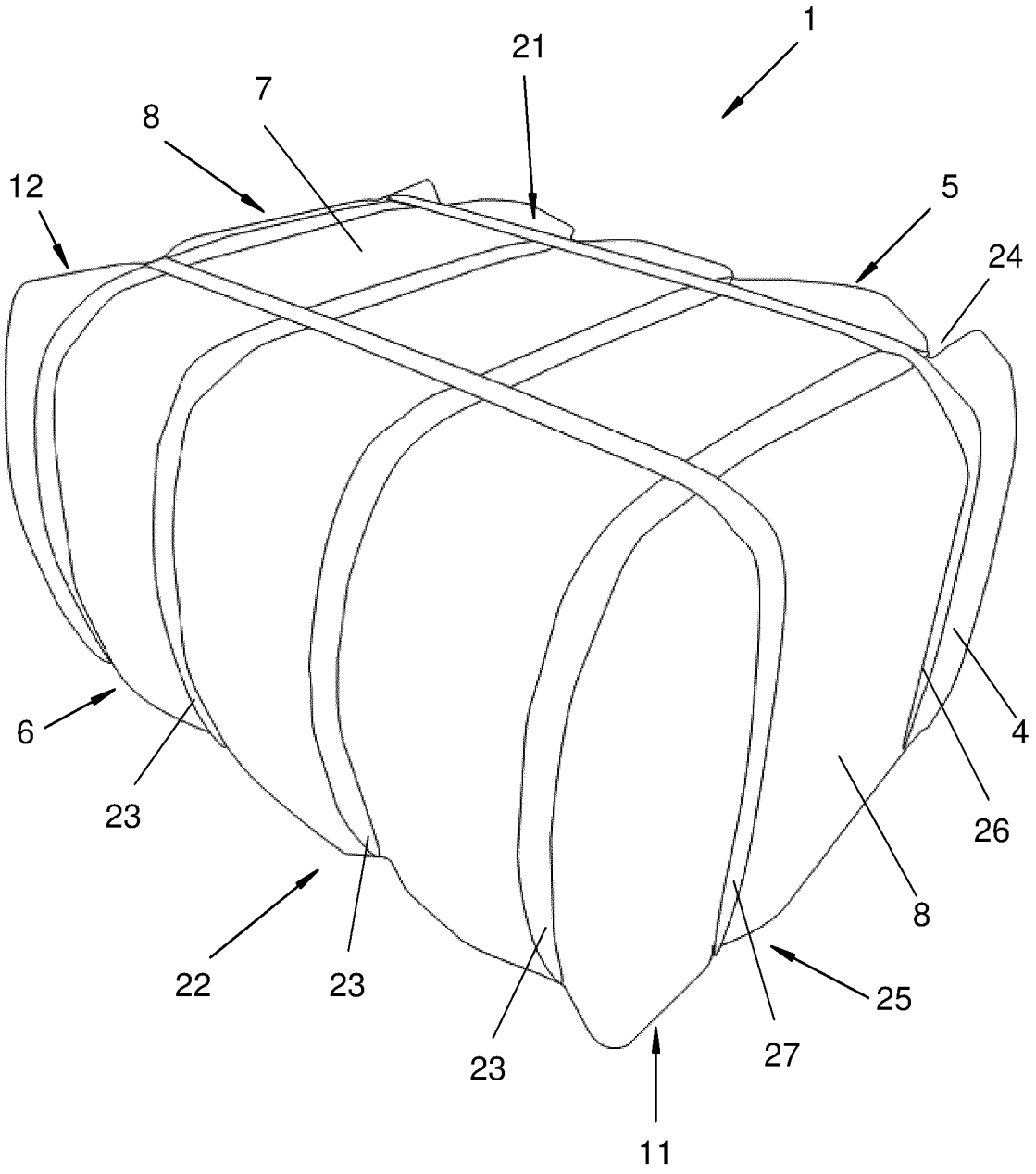
FIG. 3 is a perspective view of the packaged compressed bale from FIG. 1.

Referring to the drawings, the present invention pertains to a compressed bale (1) and to a packaging device (3) as well as to a packaging process for the compressed bale (1). The present invention further includes a production device (2) and a production process with said packaging device (3) and with the packaging process.

FIGS. 1 through 4 show a compressed bale (1) with a surrounding packaging (11) in different views. FIG. 1 additionally schematically shows a pressing device (32), e.g., a press punch, with strapping grooves (33). This pressing device (32) is pressed against the compressed bale (1) during the bale production with a high pressing force (F) in a preferably linear pressing direction (10). FIG. 1 schematically shows, in addition, a press box wall (35) of a press box (34), which is shown, e.g., in FIGS. 6 through 9.

The compressed bale (1) consist of highly compressed and preferably short-cut textile fibers. These are preferably the thermosensitive synthetic fibers mentioned in the specification introduction. The short-cut fibers are also called staple fibers. The fibers are preferably fibers, which are fresh and are not yet interwoven or otherwise connected to one another. The compressed bale (1) is pressed and compressed, e.g., with a high pressing force of 10 kN and higher.

The compressed bale (1) has a bale body (4), which has two pressing sides (5, 6) which are located opposite one another at a distance. The pressing sides (5, 6) are oriented at right angles to the pressing direction (10). They are preferably essentially parallel. The pressing devices (32) act on the pressing sides (5, 6). Further, the, e.g., essentially cuboid bale body (4) has four circumferential sides (7, 8) that are arranged between the pressing sides (5, 6) and are located opposite one another in pairs. The circumferential sides (7) are, e.g., the broad sides of the bale body (4) and the circumferential sides (8) are the narrow sides of the bale body (4). The circumferential sides (7, 8) are oriented along the pressing direction (10). The pressing sides (5, 6) and the circumferential sides (7, 8) are oriented essentially at right angles to one another.

The compressed bale (1) or its bale body (4) usually has an essentially rectangular cuboid shape. This is shown in FIG. 1 in the left-hand half of the figure. An anomaly, which sometimes occurs in practice is shown in the right-hand half of the figure. The compressed bale (1) or its bale body (4) may namely also have a cuboid-like shape with a trapezoidal shape (9) of the circumferential sides (7, 8). The parallel sides of the trapezoidal shape (9) are arranged on the pressing sides (5, 6), wherein the broader of these two trapezoidal sides is arranged on the pressing side (5), which is in front in the pressing direction (10). The trapezoidal shape (9) may be formed due to frictional resistance of the fibers at the press box wall (35).

The packaging (11) consists of a multipart film packaging (12) and of a cross strapping (21). The cross strapping (21) is formed from a first strapping (22) and a crossing additional strapping (25).

The one first strapping (22) has a plurality of parallel endless bands (23), which wrap around the bale body (4) and are thereby laid over the pressing sides (5, 6) as well as over the two opposing circumferential sides (7), especially broad sides. The bands (23) and the respective strapping plane defined by them are oriented along the pressing direction (10).

The additional strapping (25) has a plurality of endless strapping bands (26, 27), which are laid only over the circumferential sides (7, 8) of the bale body (4). Theses strapping bands (26, 27) cross the bands (23) at a preferably right angle. The strapping bands (26, 27) preferably do not extend over the pressing sides (5, 6).

The additional strapping (25) has, e.g., two strapping bands (26, 27), which are arranged parallel to one another. The strapping plane defined by each of the endless strapping bands (26, 27) is oriented at right angles to the pressing direction (10). The strapping plane of the bands (23) and the strapping plane of the strapping bands (26, 27) are oriented at right angles, preferably vertically, to one another.

The strapping bands (26, 27) of the additional strapping (25) are arranged parallel to the pressing sides (5, 6). The additional strapping (25) has, e.g., at least two strapping bands (26, 27), which are each arranged off-center and close to a pressing side (5, 6). The two strapping bands (26, 27) are arranged on both sides of the bale center. The strapping band (26) is adjacent to the, e.g., upper pressing side (5) and the other strapping band (27) is adjacent to the, e.g., lower pressing side (6). The additional strapping (25) may, in addition, have additional strapping bands (not shown).

The strapping bands (26, 27) of the additional strapping (25) are tightened. They rest with pressure and closely on the bale body (4). The band tension is applied in a suitable manner during the laying of the strapping bands (26, 27). The strapping bands (26, 27) have, e.g., each a connector (28) that connects and secures the band ends in their tightened position. The strapping bands (26, 27) may have, e.g., a width of 10-15 mm They may consist of plastic; as an alternative, they may consist of metal or of a different material. The connector (28) may be configured, e.g., as a frictional welded connection of plastic strapping bands (26, 27).

In the embodiment shown, the strapping bands (26, 27) are configured as tension-proof bands with finite length. They are pulled tight and tightened during the placement on the compressed bale (1), wherein their band ends are connected in the tightened position and are fixed by the connector (28).

In another variant, the strapping bands (26, 27) may be configured as finite bands which are elastic under tension, e.g., flat adhesive bands, which is elastically stretched during the placement. In this case, the connector (28) may be configured as mutual bonded connection of the overlapping band ends. The strapping bands (26, 27) may, in addition, be configured as endless bands that are elastic under tension with a closed ring shape, which have a smaller circumference than the compressed bale (1), whereby they are expanded with a stretching frame during the placement and are applied to the compressed bale (1), wherein they are then pressed elastically onto the compressed bale (1).

The strapping bands (26, 27) may be configured, e.g., as the shown flat bands with a rectangular cross section. They may, as an alternative, have a different cross-sectional shape. This includes oval or circular cross sections. The strapping bands (26, 27) may also have the shape of ropes.

The one and, e.g., upper strapping band (26) is applied to the broader and, e.g., upper side of the trapezoidal shape (9). The other and, e.g., lower strapping band (27) is applied to the narrower and, e.g., lower side of the trapezoidal shape (9). Due to the tightening of the strapping bands (26, 27), the respective strapping band (26, 27) may be adapted to the circumferential length of the bale body (4), which circumferential length is different in case of a trapezoidal shape (9).

The film packaging (12) has a multipart configuration. It may have, e.g., two, three or more parts. It has a three-part configuration in the embodiment being shown. The film packaging (12) has a bottom film (13) and a top film (14) as well as a cover film (15). The top film (14) is applied to the pressing side (5) located in front towards the pressing direction (10). The bottom film (13) covers the other pressing side (6). The top film (14) and the bottom film (13) rest directly on the compressed bale (1) or on the bale body (4). The endless cover film (15) wraps around the circumferential sides (7, 8) of the bale body (4). It lies externally on the top film (14) and on the bottom film (13). The cover film (15) may be dispensed with, e.g., in a two-part film packaging.

The film packaging (12) and the films (13, 14, 15) consist, e.g., of a plastic material. This plastic material may melt under heat, e.g., during a welding process for film connection. The film material may, further, not be stretchy or be only slightly stretchy. It has, as a result, a higher strength and resilience to external stresses, especially a bale expansion after press relief. Such a film material may consist, e.g., of polyethylene or polypropylene and may also possibly be strengthened by embedded ribbons, by stretching or the like and be stretch-resistant. Film material with embedded parallel ribbons or with embedded fabric is called ribbon film or fabric film.

The bottom film (13) and the top film (14) are present during the manufacture of a compressed bale as flat film blanks, which are laid flatly on a respective pressing side (5, 6) and thereby protrude over the bale circumference. These overhangs are each bent over and laid on the circumferential sides (7, 8). As a result, edge folds (17) are formed. In the three-part film packaging (12) shown according to FIGS. 1 and 2, the edge folds (17) of the top film and of the bottom film (14, 13) are spaced apart from one another. FIGS. 1 and 2 illustrate the arrangement.

Further, corner folds, which are subsequently bent over on a circumferential side (7, 8), e.g., on the respective narrow side (8) and form a corner fold (18), are formed from the preferably rectangular film blanks of top film and bottom film (14, 13) during the folding down of corner folds. The corner folds (18) are shown in FIG. 2. As an alternative, the corner folds may be folded over on the broad circumferential side (7) and possibly be held by the one first strapping (22).

The cover film (15), which is also called binder, is applied to the bale body (4) after the bottom film and the top film (13, 14) during the compressed bale manufacture. The cover film (15) is thereby wrapped around the circumferential side (7, 8) and in the process overlaps the edge folds (17) and the corner folds (18) while forming an overlap (19) in at least some areas. The application of the cover film (15) may take place before the application of the one first strapping (22).

The at least two strapping bands (26, 27) of the additional strapping (25) are arranged on the edge folds (17) and on the corner folds (18). They are also arranged on the overlaps (19) in case of a three-part film packaging (12). FIGS. 1 and 2 show this arrangement.

Figure 11:
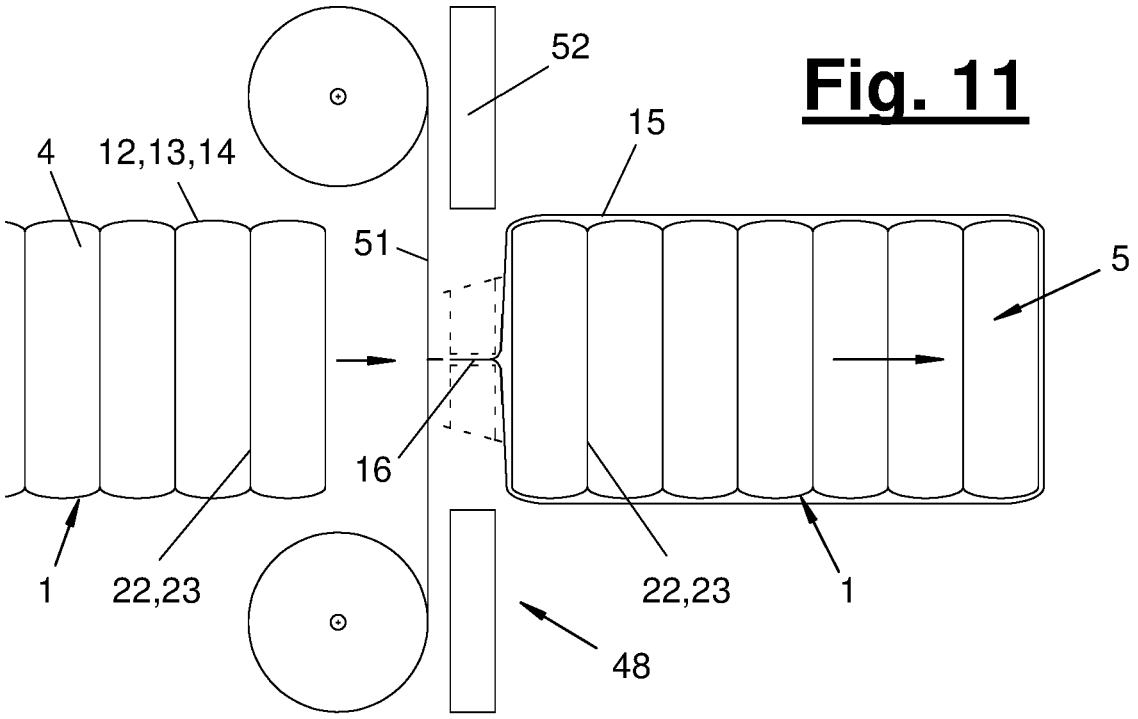
FIG. 11 is a top view of a strapped compressed bale with an application component and with a connection tool for the application of a cover film to the compressed bale.
Figure 12:
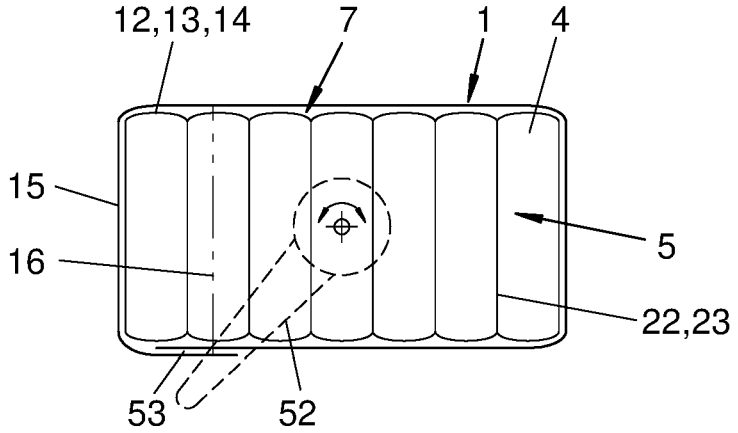
FIG. 12 is a top view showing a variant of a compressed bale and of an application component with a different cover film.
Figure 13:
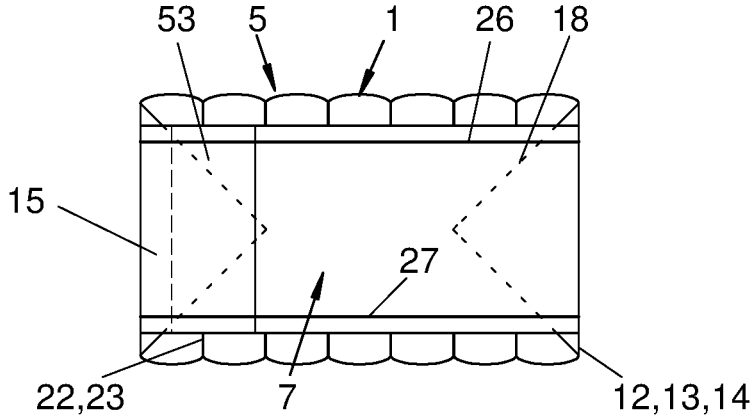
FIG. 13 is a side view showing a variant of a compressed bale and of an application component with the different cover film.

The cover film (15), which is endless in the final state, is likewise formed from a finite and, e.g., rectangular film blanks, which is wrapped around all circumferential sides (7, 8) and encloses the circumference of the bale body (4) in a closed ring, where the free ends of the film blank are then connected with a connection means (16). This may be, e.g., a weld seam shown in FIG. 2. As an alternative, the connection means (16) may be configured as a clamping or bonding or in a different manner. FIGS. 11 through 13 show embodiment variants for this.

Figure 4:
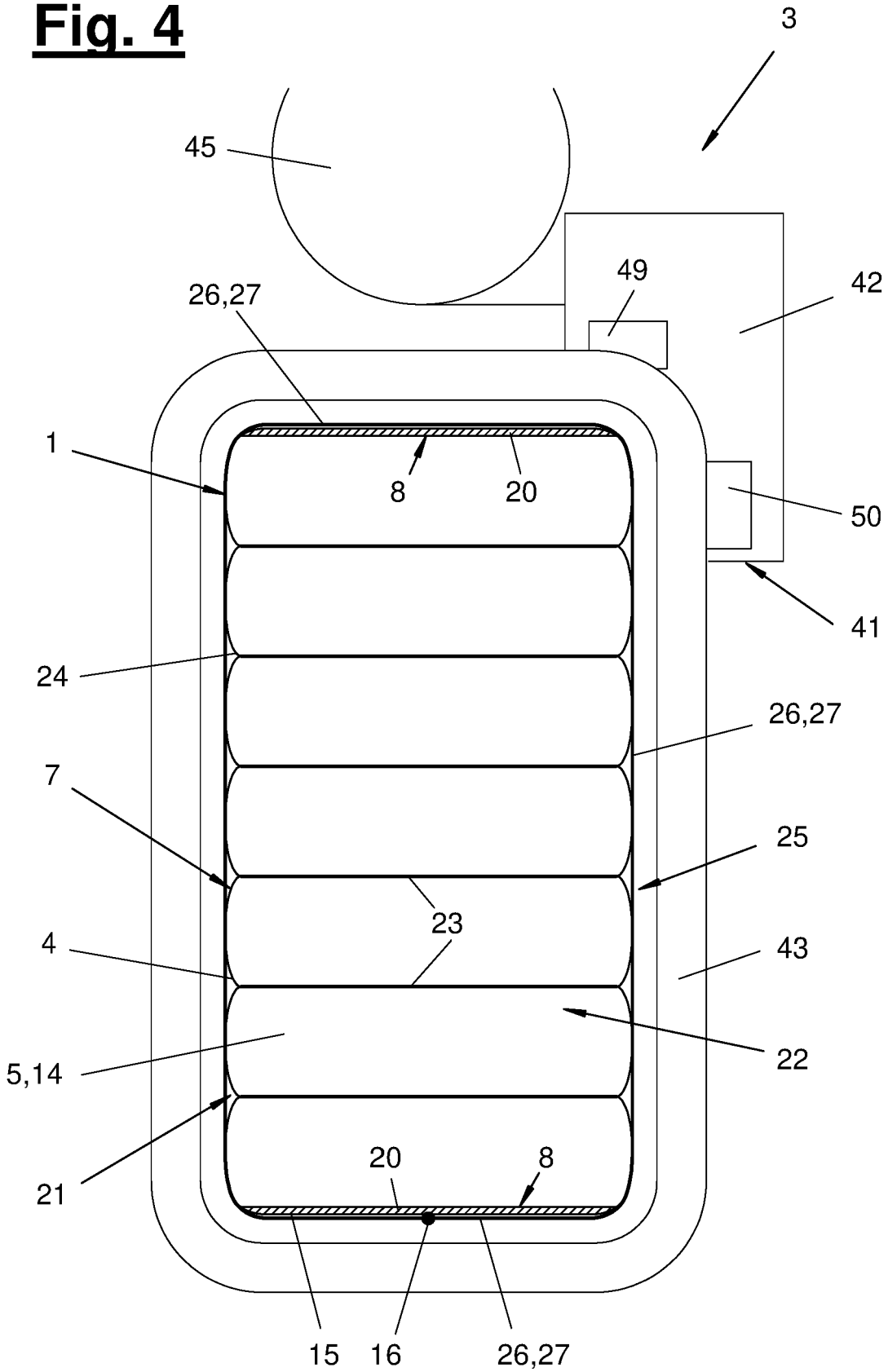
FIG. 4 is a top view of a compressed bale according to arrow IV from FIG. 2 and also showing an arrangement of a strapping apparatus at the compressed bale.

The cover film (15), which consists, e.g., of a material which is not stretchy or is not very stretchy, may have a greater circumferential length than the bale body (4). This may be due to the type of the connection means (16) and the connection tool (52). Due to this excessive length, an overhang (20) of the cover film (15) vis-à-vis the circumferential sides (7, 8) may be formed. The overhang (20) is usually located on the circumferential sides not covered by the strapping (22), e.g., the narrow circumferential sides (8). FIG. 4 illustrates this configuration. A cover film (15), consisting, e.g., of a stretchy material, e.g., PE, may be tightened as well as stretched possibly during the placement and may then shrink back elastically onto the bale body (4) and have less overhang (20). It may also be filled out and possibly stretched somewhat by the relieved bale body (4) and likewise have less overhang (20).

The strapping bands (26, 27) of the additional strapping (25) are laid over the circumferential sides (7, 8) and over the respective overhang (20). The strapping bands (26, 27) tighten the overhang (20) and press the cover film (15) tightly to the bale body (4) and to the edge folds (17) and corner folds (18), lying underneath on the overlap (19). The cross strapping (21) ensures a tight placement of the film packaging (12) on all sides of the bale body (4). In particular, the bale areas located between the overlaps (19) are sealed.

In one embodiment of the packaging technology, the multipart film packaging (2) is first applied to the compressed bale (1) or to its bale body (4). In this case, the compressed bale (1) or bale body (4) is held between pressing devices (32) under pressure in the pressing direction (10). The one first strapping (22) is then laid over the compressed bale (1) and the film packaging (12). Then, the additional strapping (25) is applied and the cross strapping (21) is formed. The strapping bands (26, 27) of the additional strapping (25) in this case rest on and over the bands (23) of the one first strapping (22). The strapping bands (26, 27) do not dig into the already expanded compressed bale (1) as deeply as the bands (23) of the one first strapping (22). This is an advantageous embodiment. On the other hand, the sequence during the application of the one first strapping (22) and of the additional strapping (25) may be transposed during an application in a baling press. An additional variant will be explained below with reference to FIG. 10.

The packaging (11) is applied to the compressed bale (1) by means of a packaging device (3). The additional strapping (25) with the one or more strapping bands (26, 27) is applied to the compressed bale (1) or to the bale body (4) by means of a strapping apparatus (41). The compressed bale (1) has been provided beforehand with the film packaging (12) and with the one first strapping (22). The strapping apparatus (41) can be operated and guided manually or may operate automatically and may possibly be arranged in a stationary manner.

The packaging device (3) may comprise at least the strapping apparatus (41). The packaging device (3) may additionally comprise a strapping device (38) for forming the one strapping (22) and/or an application device (46) for applying the film packaging (12).

The strapping apparatus (41) is arranged in a separate strapping station (45) in the embodiment being shown. It operates preferably automatically here. The application of the additional strapping (25) may, as a result, take place separately in terms of location and time from the application of the film packaging (12) and from the application of the one strapping (22) to the compressed bale (1).

The strapping apparatus (41) may be configured in a different manner. FIG. 4 shows a schematic exemplary embodiment.

The additional strapping (25) may be applied horizontally to a compressed bale (1) that is lying on a pressing side (6). As an alternative, the compressed bale (1) may be set up and lie or stand on one of its circumferential sides (7, 8). The additional strapping (25) may in this case be applied to the compressed bale (1) with a vertical orientation. A plurality of strapping bands (26, 27) may be laid around the compressed bale (1) together and simultaneously or one after the other.

The strapping apparatus (41), which is schematically shown in FIG. 4, has, e.g., a strapping head (42), a band guide (43) for at least one of the strapping bands (26, 27) and a band supply for strapping band. A tightening device (49) for the strapping band (26, 27) and a connection device (50) for the free ends of the strapping band (26, 27) and the application of the connector (28) may be arranged at the strapping head (42) or at a different location.

FIGS. 5 through 9 and 10 show each in examples a production device (2) with a packaging device (3) in different variants.

In the two variants according to FIGS. 5 through 9, the production device (2) has one or more baling presses (29). These baling presses (29) each have a prepress (30) and a finishing press (31). In the prepress (30), the fiber material is filled into a press box (34) with side press box walls and is precompressed with a prepressing device. The filling in and prepressing may take place in a batchwise manner.

In the finishing press (31), the prepressed compressed bale is finish-pressed and compressed under the above-mentioned high pressing force (F) in the pressing direction (10). Parts of the packaging device (3), especially a strapping device (38) for applying the one first strapping (22) and/or an application device (46) for applying the film packaging (12) to the compressed bale (1), may be arranged at the finishing press (31). The bottom film (13) and the cover film (14) may be applied and temporarily fixed to pressing devices (32), e.g., before the pressing. The application device (46) may, as an alternative, may be arranged at the prepress (30).

Figure 5:
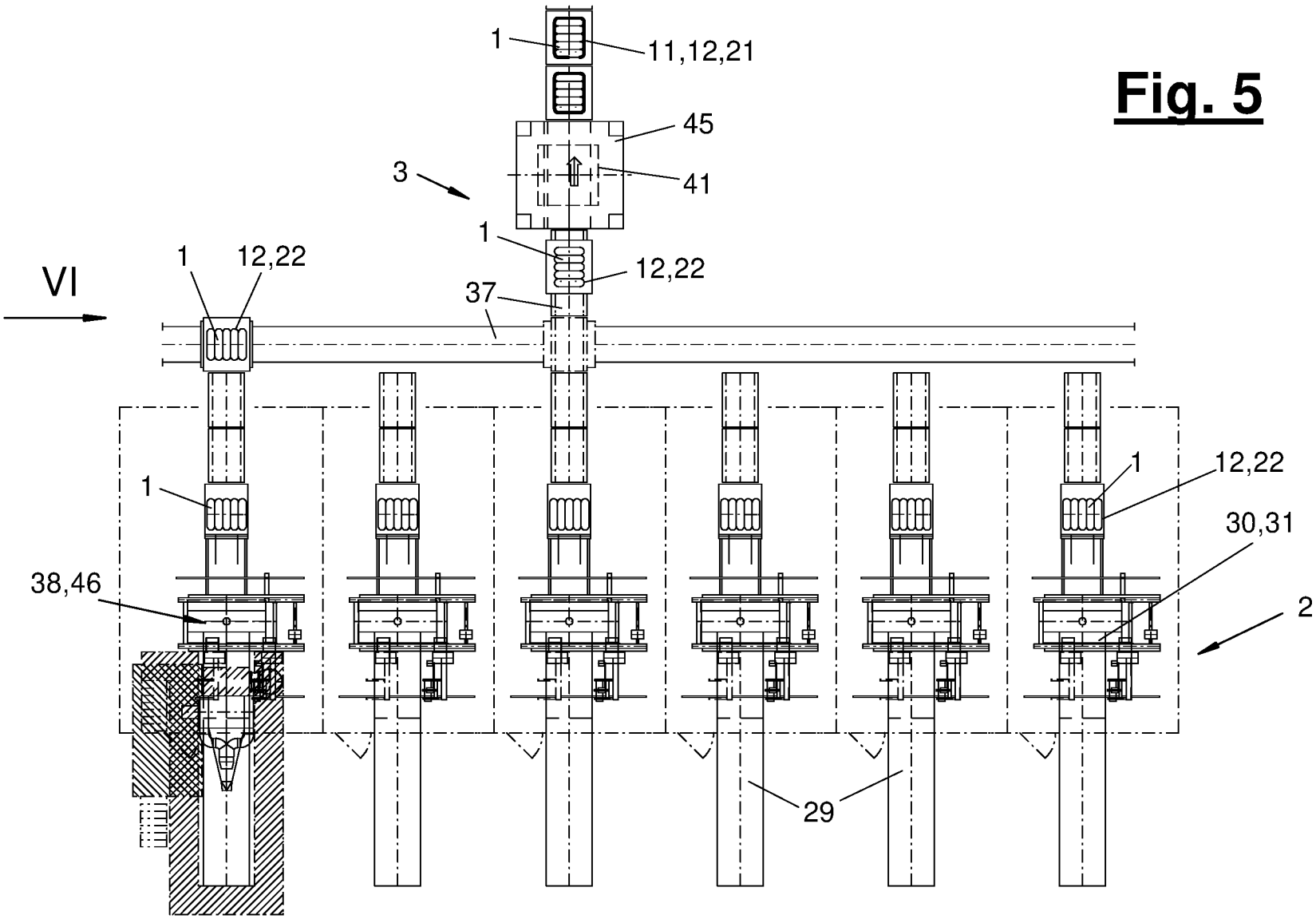
FIG. 5 is a top view of a production device with a plurality of compressed bales and with an external strapping station with a strapping apparatus.
Figure 6:
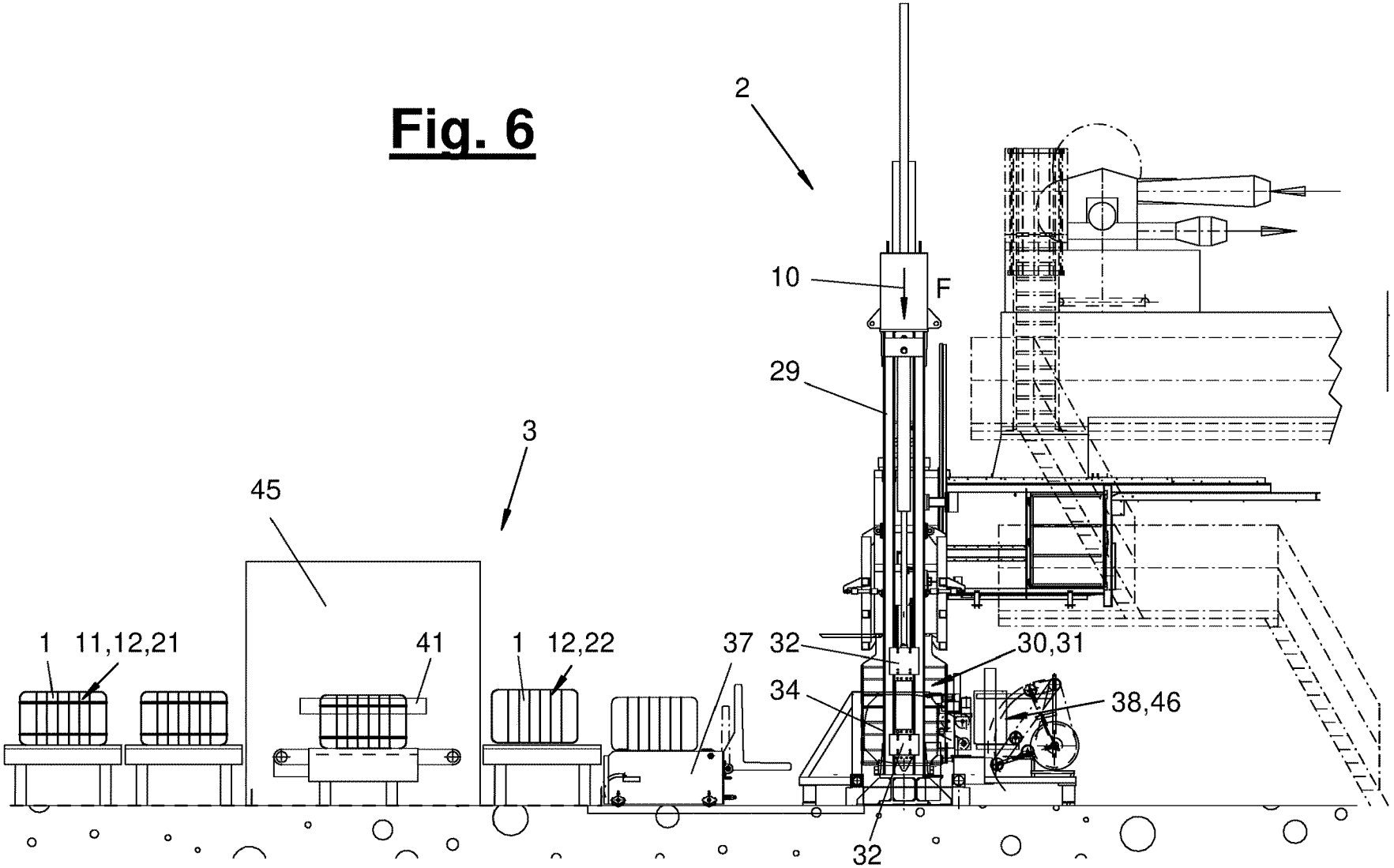
FIG. 6 is a side view of the arrangement according to arrow VI from FIG. 5.

In the variant from FIGS. 5 and 6, the prepress (30) and the finishing press (31) are combined in a baling press (29). The prepressing and the finish-pressing take place at the same location with the same pressing direction (10) and in the same press box (34). As an alternative, the baling press (29) may be configured as a rotary press with separation of the prepress and the finishing press (30, 31).

The compressed bale (1), which is finish-pressed and provided with the film packaging (12) as well as with the one first strapping (22), may be transported away from the one or more baling presses (29) by means of a bale conveyor (37) and be fed to one or more associated or central strapping stations (45) for applying the additional strapping (25). FIGS. 5 and 6 show this configuration.

The finish-packaged compressed bale (1) with the finished packaging (11) incl. film packaging (12) and cross strapping (21) can be transported away from the strapping station (45) and be stored as needed. The compressed bales (1) manufactured according to the invention are especially suitable for the formation of a stack of compressed bales. In this case, three or more compressed bales (1) can be arranged on top of one another. Such a stack of compressed bales may be stored in a warehouse or be transported away with a suitable transporting device for further use.

Figure 7:
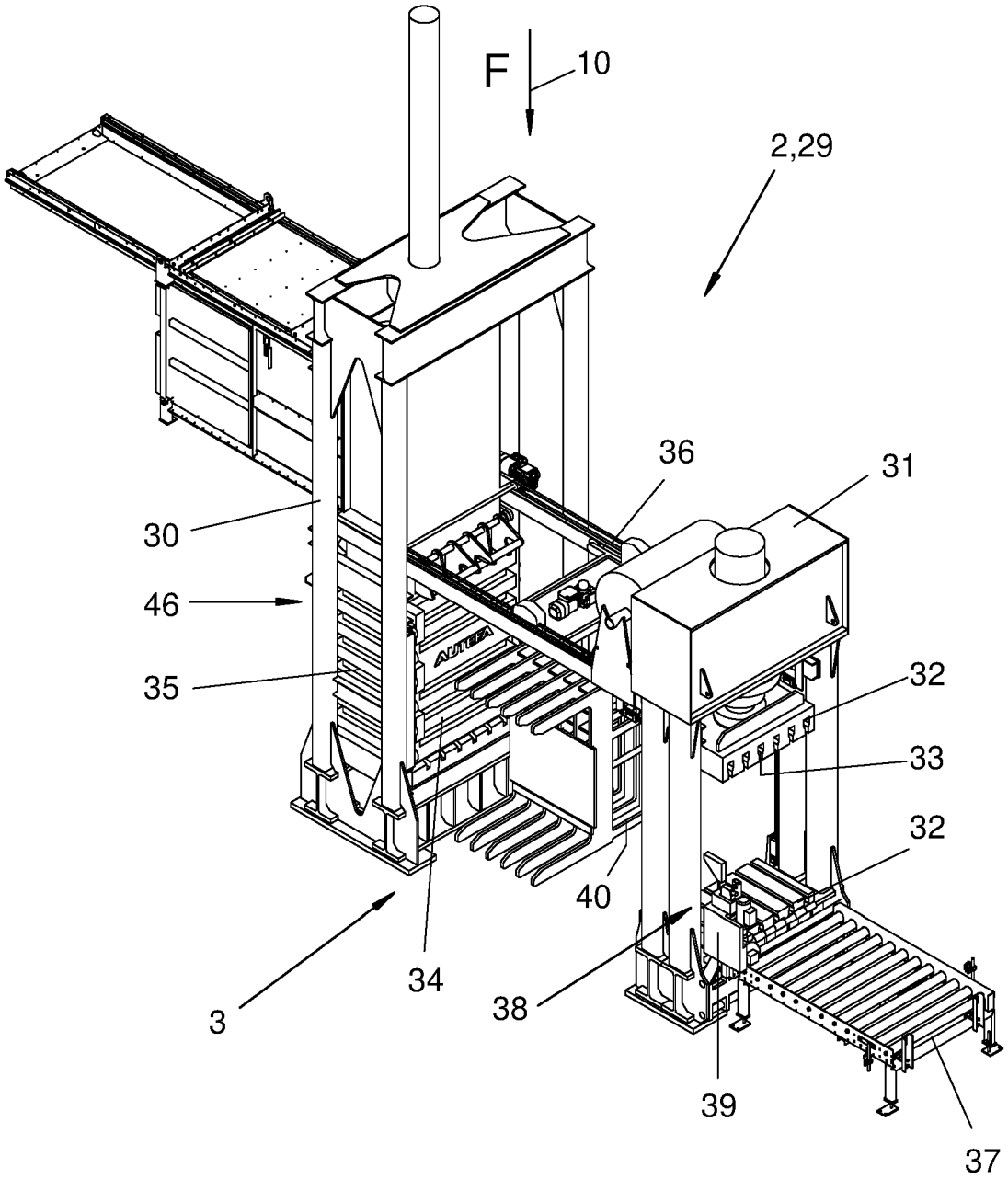
FIG. 7 is a perspective view showing another embodiment of a production device for compressed bales.
Figure 8:
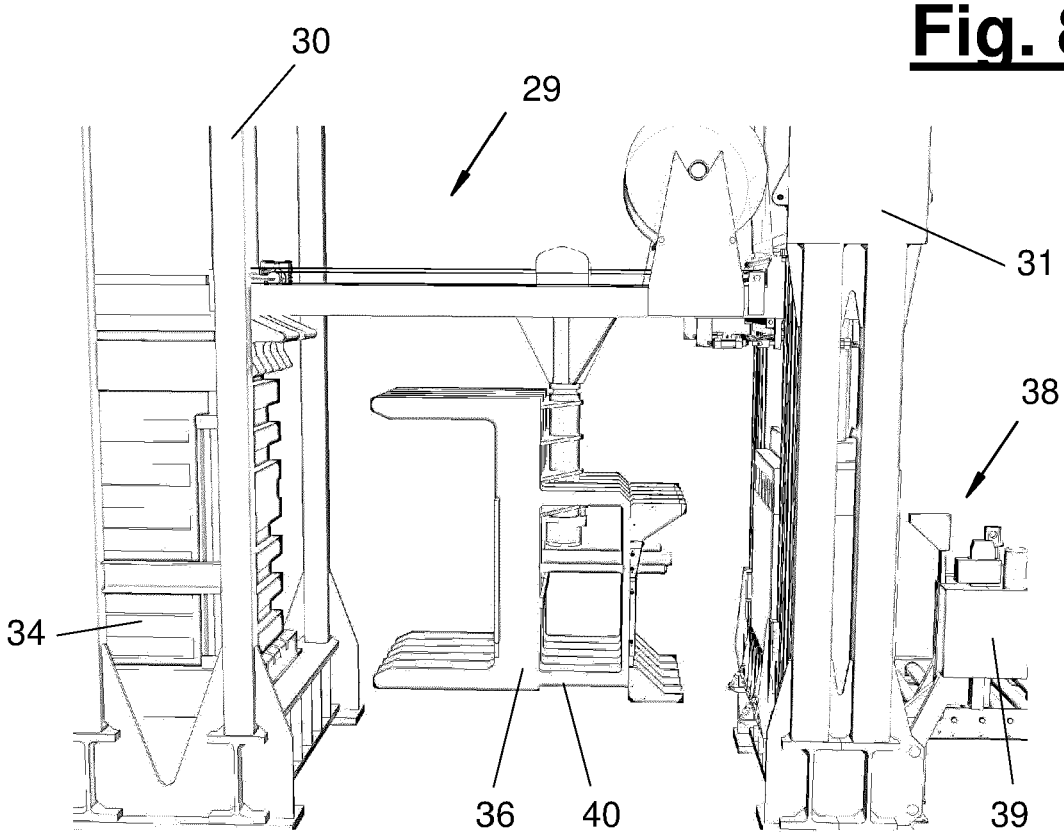
FIG. 8 is a different perspective view showing the other embodiment of a production device for compressed bales.
Figure 9:
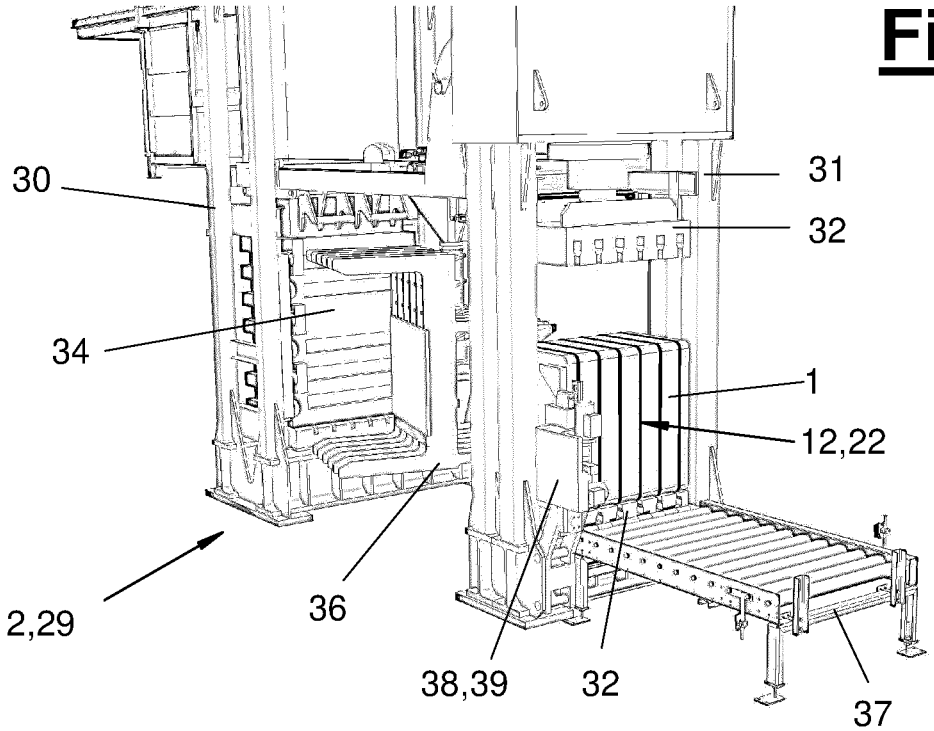
FIG. 9 is another different perspective view showing the other embodiment of a production device for compressed bales.

FIGS. 7 through 9 show a variant of a baling press (29), in which the prepress (30) and the finishing press (31) are separated from one another. In this case, a plurality of prepresses (30) may be associated with a common finishing press (31), wherein the prepressed compressed bales (1) are fed to the finishing press (31) by means of a bale transporter (36). Otherwise, the production device (2) in the variant may have the same configuration as in FIGS. 5 and 6, especially with regard to the strapping station and the bale conveyor (37).

The application device (46) for applying the film packaging (12) may be associated with the prepress (30). The bale transporter (36) has a clampable gripping fork, with which the compressed bale (1), which is provided with a multipart film packaging (12), can be removed from the prepress (30) and be fed in the prepressed state to the finishing press (31). The bale transporter (36) may be configured, e.g., as an overhead conveyor, which can be moved along and in front of the prepresses (30), with a rotatable gripping fork. The bale transporter (36) is moved in a free aisle, which is arranged between the prepresses (30) and the spaced-apart finishing press (31).

The strapping device (38) may be associated with the finishing press (31). The strapping device (38) may have a strapping head (39) and a plurality of strapping channels (40). FIG. 9 shows the finishing press (31) with the partially packaged compressed bale (1) with the film packaging (12) and with the one first strapping (22).

The finishing press (31) has the above-mentioned pressing devices (32) and a press drive. The pressing devices (32) are formed, e.g., by press punches, which are arranged vertically above one another and with a horizontal orientation, with strapping grooves (33). The press drive moves, e.g., the upper press punch (32) against the lower stationary press punch. The pressing side (5) of the compressed bale (1) points in this case towards the upper and driven press punch (32).

In the finishing press (31), the compressed bale (1), which is prepressed and is provided with the film packaging (12), is finish-pressed and compressed, wherein the one first strapping (22) is applied in the pressed state to the compressed bale (1) by the strapping grooves (33). In case of a subsequent press relief, the compressed bale (1) relaxes in the pressing direction (10) and thereby stretches the film packaging (12), wherein the bands (23) of the one strapping (22) also cut into the bale body (4) and form the constrictions (24). The constrictions (24) are deeper on the pressing sides (5, 6) than on the circumferential sides (7), especially on the broad sides. The pressing sides (5, 6) can be distinguished from the strapped circumferential sides (7) by means of the different constrictions (24).

Figure 10:
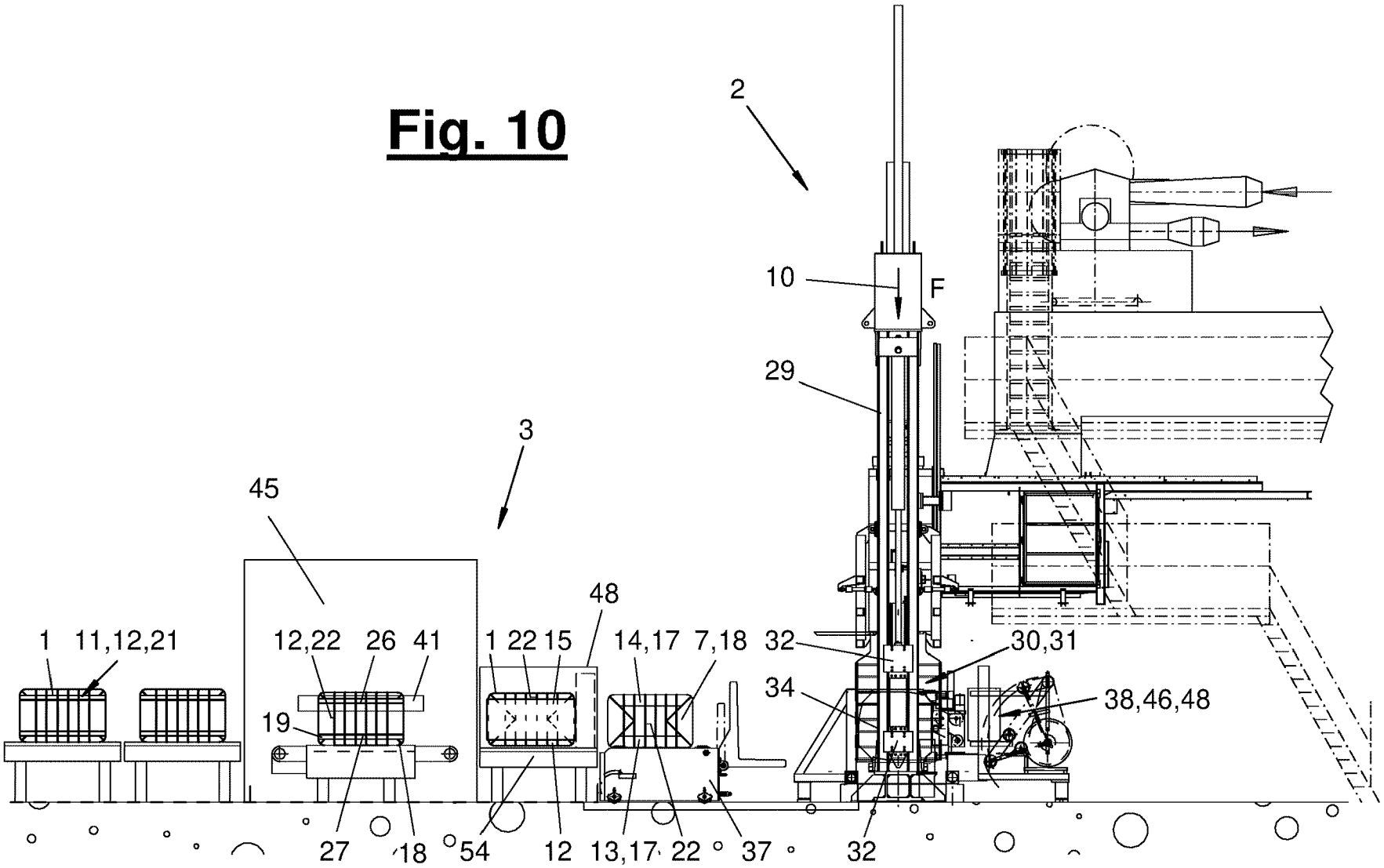
FIG. 10 is a side view showing a variant of the arrangement from FIGS. 5 and 6 with a split application device for the multipart film packaging.

FIG. 10 shows another variant of the production device (2). This differs in the configuration and arrangement of the application device (46) from the embodiment from FIGS. 5 and 6.

In the variant of FIG. 10, the application device (46) has a multipart configuration for application of the multipart film packaging (12). The application device (46) has an application component (47), which is arranged at the baling press (29) and which applies the first part or the first parts of the film packaging (12) to the compressed bale (1) or to the bale body (4) thereof. This may be, e.g., the shown bottom film (13) and top film (14) that are applied to the compressed bale held between the pressing devices (32) by means of a laying device and folding fingers or the like and forming edge folds (17) and the corner fold (18). As an alternative, a first part of the film packaging (12) may be formed from at least one hood or in a different manner. The first part or the first parts of the film packaging (12) are subsequently provided with the one first strapping (22) by the strapping device (38) and fixed.

As FIG. 10 illustrates, each corner fold (18) may be folded onto the broad circumferential side (7) and may be fixed here by one or more bands of the first strapping (22). The partially packaged and strapped compressed bale (1) is then transported away with a bale conveyor (37).

The application device (46) further comprises a second application component (48), which applies an additional part of the film packaging (12), e.g., a cover film (15), to the partially packaged and strapped compressed bale (1). The application component (48) is arranged upstream, e.g., of the strapping station (45) or is integrated in this strapping station (45).

FIG. 11 shows a first variant of the application component (48). The cover film (15) may be formed by a film curtain (51) defined between two film coils and wrapped as a horizontal binder around the compressed bale (1), which is transported and moved by a conveyor (54) in the arrow direction during the transporting movement, and may be applied by cutting off and connecting, e.g., welding of the film ends by means of an adjustable connection tool (52). In this case, on the one hand, the connection means (16) of the cover film (15) and, on the other hand, a film curtain (51) are again formed behind the separation point. The conveyor (54) may be part of the bale conveyor (37).

FIGS. 12 and 13 disclose a second variant of the application component (48). The cover film (15) is wrapped around the compressed bale (1) with a connection tool (52), wherein its film ends are laid above one another on one circumferential side (7, 8), forming an overlap (53). The overlap (53) is located, e.g., on a broad side (7). Also in this variant, the cover film (15) encloses the compressed bale (1) or the bale body thereof in a closed ring. The overhang (20) may be smaller than in the previous exemplary embodiment or be dispensed with. This application variant has advantages in case of the formation of the cover film (15) from a tension-proof and stretch-resistant material, e.g., PP or ribbon film or fabric film.

The cover film (15) may be fixed to the overlap (53) with a connection means (16). This connection means (16) may be formed, e.g., by a bond or by a strapping band laid over the overlap (53). This may extend, e.g., parallel to the bands (23) of the first strapping (22).

In a view shown in broken line, FIG. 12 illustrates a connection tool (52). This connection tool (52) has, e.g., a swivel arm, which can be rotated in relation to the currently stationary compressed bale (1), with a gripping device, which grips a film end at a feed from a film coil, not shown, of the cover film (15) and in a rotary movement wraps around the circumferential sides (7, 8) of the compressed bale (1), wherein the initial film end is held at the compressed bale (1) with a suitable fixing means. After formation of the overlap (53), the cover film (15) is separated from the film web fed from the coil and the connection means (16) is positioned. The separated and feed-side end of the film web remains connected to the connection tool (52) and is ready for the next application process of a cover film or binder (15). The connection tool may be configured, e.g., according to WO 2005/012098 A1 or WO 2015/114532 A1.

In another variant, not shown, the connection tool (52) may be configured according to EP 0 528 892 B1 and have a film arm, which can be moved along and at right angles to the compressed bale (1), with a gripper, which pulls off the cover film (15) from a stationary or carried-along film coil, wraps around the compressed bale and connects the film ends to one another with or without overlap as well as again grasps the feed-side film end for the next application process.

The above-described connection tool (52) may be used with corresponding adaptation also for an application of the cover film (15) within the baling press to the compressed bale (1) held between the pressing devices (32).

EP 0 528 892 B1, WO 2005/012098 A1 and WO 2015/114532 A1 are integrated by reference (incorporated by reference) into this application disclosure.

The cover film (15) is located in both variants externally on the bottom film and the top film (13, 14) and on the first strapping (22).

The additional strapping (25) is applied in the manner described above and the cross strapping (21) is formed in the downstream strapping station (45). The additional strapping (25) is applied externally to the cover film (15) and is located in the manner described above on the overlap (19) and possibly on the corner fold (18). The cover film (15) is located between the strappings (22, 25).

Different variations of the embodiments shown and described are possible.

In the exemplary embodiments shown, the baling presses (29) are configured as vertical presses, which have a vertical pressing direction (10) and upper and lower pressing devices (32) or press punches. As an alternative, a different configuration, e.g., as a horizontal press with an especially horizontal pressing direction (10) and corresponding orientation of the pressing devices (32) and of the press drives is possible.

A multipart film packaging (12) may be a two-part film packaging. It may be formed, e.g., from two hood-like or bag-like bottom films (13) and top films (14). In a two-part configuration, the hoods or bags may overlap one another. In a three-part configuration of the film packaging (12), the bags or hoods may be enclosed by a ring-shaped endless or overlapped cover film (15) with overlap analogously to FIG. 1.

The compressed bale (1) may have a shape which is different from the preferred cuboid shape and correspondingly differently configured circumferential side(s).

Further, it is possible to combine and especially to transpose the features of the above-described exemplary embodiments and of the mentioned variations in a different manner with one another.

While specific embodiments of the invention have been shown and described in detail to illustrate the application of the principles of the invention, it will be understood that the invention may be embodied otherwise without departing from such principles.

LIST OF REFERENCE CHARACTERS

1 Compressed bale
2 Production device
3 Packaging device
4 Bale body
5 Pressing side, top, top side
6 Pressing side, bottom, bottom side
7 Circumferential side, broad side
8 Circumferential side, narrow side
9 Trapezoidal shape
10 Pressing direction
11 Packaging
12 Film packaging
13 Bottom film
14 Top film
15 Cover film, binder
16 Connection means
17 Edge fold
18 Corner fold
19 Overlap
20 Overhang
21 Cross strapping
22 Strapping
23 Band
24 Constriction
25 Additional strapping
26 Strapping band
27 Strapping band
28 Connector
29 Baling press
30 Prepress
31 Finishing press
32 Pressing device, press punch
33 Strapping groove
34 Press box
35 Press box wall
36 Bale transporter
37 Bale conveyor
38 Strapping device
39 Strapping head
40 Strapping channel
41 Strapping apparatus
42 Strapping head
43 Band guide
44 Band supply
45 Strapping station
46 Application device
47 Application component, bottom film and top film
48 Application component, cover film
49 Tightening device
50 Connection device
51 Film curtain
52 Connection tool
53 Overlap
54 Conveyor
F Pressing force

The invention claimed is:

1. A compressed bale comprising:
a bale body;
a packaging surrounding and fully enveloping the bale body, wherein the compressed bale is formed from highly compressed, short-cut, textile fibers and has mutually opposite pressing sides and circumferential sides arranged between the pressing sides, wherein the pressing sides were acted on by a pressing device in a pressing direction during the manufacture of the compressed bale and wherein the packaging comprises:
a multipart film packaging comprising a plurality of flexurally elastic packaging films made of plastic and resting on the bale body and comprising a bottom film arranged on one of the pressing sides and in some areas covering adjoining circumferential sides, a top film arranged on another of the pressing sides and in some areas cover adjoining circumferential sides and a ring-shaped, closed cover film on the circumferential sides, the cover film providing an overlap at which the cover film overlaps and covers the top film and the bottom film externally on the circumferential sides in at least some areas; and
a cross strapping comprising:
a first strapping comprising a plurality of parallel endless bands that are laid over the pressing sides of the compressed bale, the plurality of parallel endless bands digging into the bale body on the pressing sides and forming constrictions; and
an additional strapping arranged externally on the film packaging as well as on the plurality of parallel endless bands, the additional strapping comprising: a plurality of additional endless strapping bands which are laid peripherally only over the circumferential sides and cross the plurality of parallel endless bands, wherein at least one of the plurality of additional endless strapping bands is arranged on the overlap.

2. A compressed bale in accordance with claim 1, wherein the compressed bale has a rectangular cuboid shape with circumferential sides in a trapezoidal shape.

3. A compressed bale in accordance with claim 1, wherein the plurality of additional endless strapping bands are two strapping bands, which are arranged off-center and adjacent to the pressing sides and wherein the cover film provides a second overlap at which the cover film overlaps and covers the top film externally on the circumferential sides in at least some areas and each of the two additional endless strapping bands is respectively arranged on one of the two overlaps.

4. A compressed bale in accordance with claim 1, wherein the plurality of additional endless strapping bands are tightened and are applied with pressure as well as closely to the bale body and to the film packaging.

5. A compressed bale in accordance with claim 1, wherein the first strapping comprising the plurality of parallel endless bands is arranged externally directly on the bottom film, on the top film and on the cover film, wherein the additional strapping is arranged externally on the bottom film, on the top film and on the cover film as well as on the additional strapping comprising the plurality of parallel endless bands.

6. A compressed bale in accordance with claim 1, wherein the first strapping, comprising the plurality of parallel endless bands, is arranged externally directly on the bottom film and on the top film, wherein the cover film is arranged externally on the bottom film, on the top film and on the first strapping comprising the plurality of parallel endless bands, and wherein the additional strapping is arranged externally on the cover film.

7. A compressed bale in accordance with claim 1, wherein the bottom film and the top film each have an edge fold folded over onto the circumferential sides as well as a folded-over corner fold, wherein the strapping bands of the additional strapping are arranged on the folded over edge folds as well as on the folded over corner folds.

8. A compressed bale in accordance with claim 1, wherein the cover film of the film packaging comprises an endless cover film or a cover film overlapped at the end with a connection comprising a weld seam, wherein the cover film has an overhang vis-à-vis the compressed bale, and wherein at least one strapping band of the additional strapping is arranged on the overhang.

9. A packaging device for compressed bales for applying a packaging surrounding a compressed bale, wherein the compressed bale is formed from compressed textile fibers and has mutually opposite pressing sides and circumferential sides arranged between the pressing sides wherein the pressing sides were acted on by a pressing device in a pressing direction during the manufacture of the compressed bale, and wherein the packaging comprises a multipart film packaging resting on the bale body and a first strapping with a plurality of parallel endless bands which are laid over the pressing sides of the compressed bale, the packaging device comprising:

an application device configured to apply the multipart film packaging to the compressed bale, wherein the multipart film packaging comprises a bottom film, a top film and a ring-shaped, closed, cover film, and configured to apply the bottom film and the top film to the compressed bale with the compressed bale held under compression and subsequently to apply the cover film to the compressed bale, the cover film providing an overlap at which the cover film overlaps and covers the top film externally on the circumferential sides in at least some areas and at least partially covers the parallel endless bands and the first strapping; and a strapping apparatus configured to apply an additional strapping to the compressed bale having the multipart film packaging resting on the bale body and the first strapping with a plurality of parallel endless bands which are laid over the pressing sides of the compressed bale, with the additional strapping comprising: a plurality of parallel endless strapping bands, which are laid peripherally only over the circumferential sides and are arranged externally on the film packaging as well as outwardly of the parallel endless bands wherein at least one endless strapping band of the additional strapping is arranged on the overlap, wherein the endless strapping bands cross the parallel endless bands, forming a cross strapping.

10. A packaging device in accordance with claim 9, further comprising:

a tightening device; and a connection device, wherein the strapping apparatus comprises a strapping head, a band guide and a strapping band supply of the additional strapping band, wherein the tightening device is configured to tighten the additional strapping band, the connection device is configured to connect free ends of the additional strapping band and the tightening device and the connection device are arranged at the strapping apparatus.

11. A packaging device in accordance with claim 9, wherein the strapping apparatus operates manually or automatically and is arranged in a separate strapping station, which separate strapping station is separated in space from the application device applying the top film and the bottom film.

12. A packaging device in accordance with claim 9 wherein the strapping device is configured to apply the first strapping, comprising the plurality of parallel endless bands, to the compressed bale with the compressed bale held under compression.

13. A packaging device according to claim 9 in combination with a bale pressing configuration to form a production device for compressed bales, which are formed from compressed textile fibers and have mutually opposite pressing sides and circumferential sides arranged between the pressing sides wherein the pressing sides are acted on by a pressing device of the bale pressing configuration in a pressing direction during the manufacture of the compressed bale.

14. A packaging device in accordance with claim 13, wherein the bale pressing configuration of the production device comprises one or more baling presses.

15. A packaging device in accordance with claim 14, wherein the manual or automatic strapping apparatus s arranged n an external strapping station, which is outside of the one or more baling presses.

16. A packaging device in accordance with claim 13, wherein the application device comprises:

an application component arranged at one or more baling presses of the bale pressing configuration and configured to apply the bottom film and the top film to the compressed bale acted on by the pressing device; and an application component arranged outside of one or more baling presses, for applying the ring-shaped, closed cover film to the compressed bale.

17. A process for packaging compressed bales, the process comprising the steps of:

providing a packaging surrounding a compressed bale;

forming the compressed bale from compressed, short-cut, textile fibers and has mutually opposite pressing sides and circumferential sides arranged between the pressing sides wherein the pressing sides are acted on by a pressing device in a pressing direction during the forming of the compressed bale and wherein the packaging has a multipart film packaging comprising a plurality of flexurally elastic packaging films made of plastic resting on the bale body and a first strapping comprising a plurality of parallel endless bands which are laid over the pressing sides of the compressed bale the bands digging into the expanded bale body on the pressing sides and forming constrictions;

applying an additional strapping with a plurality of parallel endless strapping bands to the compressed bale, which bands are laid peripherally only over the circumferential sides and are arranged externally on the film packaging as well as on the bands, wherein the strapping bands cross the bands, forming a cross strapping, wherein the multipart film packaging comprises a bottom film and a top film, which are arranged on the pressing sides and in some areas cover the adjoining circumferential sides, and a ring-shaped, closed cover film on the circumferential sides, which cover film overlaps and covers the top film and the bottom film externally on the circumferential sides in at least some areas to provide an overlap, wherein at least one strapping band of the additional strapping is arranged on the overlap.

18. A process in accordance with claim 17, wherein the bottom film and the top film of the multipart film packaging are applied directly to the pressing sides and cover the adjoining circumferential sides in some areas, wherein, in addition, the ring-shaped, closed cover film of the multipart film packaging is applied to the circumferential sides which cover film overlaps and covers the bottom film and the top film externally on the circumferential sides in at least some areas, wherein the plurality of parallel endless strapping bands of the additional strapping is applied to the overlaps.

19. A process in accordance with claim 17, wherein the first strapping comprising the plurality of parallel endless bands is applied externally directly to the bottom film, to the top film and to the cover film, wherein the additional strapping is then subsequently applied externally to the bottom film, to the top film and to the cover film as well as to the strapping comprising the plurality of parallel endless bands.

20. A process in accordance with claim 17, wherein the cover film is applied to a compressed bale subsequently and outside of a baling press, which compressed bale is already provided with a first part of the multipart film packaging and with the strapping comprising the plurality of parallel endless bands and wherein the additional strapping is subsequently applied to the cover film, wherein the cover film is arranged between the one strapping comprising the plurality of parallel endless bands and the additional strapping.

* * * * *